US006934979B2

(12) United States Patent
Swan

(10) Patent No.: US 6,934,979 B2
(45) Date of Patent: Aug. 30, 2005

(54) CONVERTIBLE BENCH

(75) Inventor: Ralph J. Swan, 611 Chestnut Dr., Oswego, IL (US) 60543

(73) Assignees: Design Innovations Inc., Batavia, IL (US); Ralph J. Swan, Oswego, IL (US)

( * ) Notice: Subject to any disclaimer, the term of this patent is extended or adjusted under 35 U.S.C. 154(b) by 0 days.

(21) Appl. No.: 10/425,087

(22) Filed: Apr. 28, 2003

(65) Prior Publication Data

US 2004/0211001 A1 Oct. 28, 2004

(51) Int. Cl.[7] ..... A47C 17/23; A47C 17/24

(52) U.S. Cl. ..... 5/81.1; 5/30; 297/118

(58) Field of Search ..... 297/118, 107, 297/111, 122, 119, 188.11, 108; 5/28, 30, 20, 18.1, 17, 21, 58; 312/235.5, 23

(56) References Cited

U.S. PATENT DOCUMENTS

| | | | | | |
|---|---|---|---|---|---|
| 150,290 | A | * | 4/1874 | Close et al. | 5/30 |
| 180,694 | A | * | 8/1876 | York | 5/30 |
| 183,963 | A | * | 10/1876 | Pabst | 5/30 |
| 351,029 | A | * | 10/1886 | Haralson et al. | 5/30 |
| 523,372 | A | * | 7/1894 | Phillips et al. | 5/30 |
| 907,311 | A | * | 12/1908 | Bowdon | 297/118 |
| 984,699 | A | * | 2/1911 | Plunkett | 5/18.1 |
| 984,829 | A | * | 2/1911 | Luppino | 5/30 |
| 993,856 | A | * | 5/1911 | Mason | 5/30 |
| 1,912,711 | A | * | 6/1933 | Kindel | 5/186.1 |
| 2,096,059 | A | * | 10/1937 | Perlesz | 5/18.1 |
| 2,703,411 | A | * | 3/1955 | Kelly | 5/18.1 |
| 2,720,659 | A | * | 10/1955 | Brown | 297/118 |
| 3,906,558 | A | * | 9/1975 | Alembik | 297/118 |
| 4,134,613 | A | * | 1/1979 | Logan, Jr. | 297/107 |
| 4,226,470 | A | | 10/1980 | Wittmann et al. | 297/108 |
| 4,248,476 | A | | 2/1981 | Phelps | 297/118 |
| 4,662,015 | A | | 5/1987 | Galumbeck | 5/504 |
| 5,101,524 | A | * | 4/1992 | Brandschain | 5/17 |
| 5,486,041 | A | * | 1/1996 | Sykes | 312/111 |
| 5,687,435 | A | | 11/1997 | Dufresne | 5/10.1 |
| 5,720,057 | A | * | 2/1998 | Duncan | 5/420 |
| 5,794,283 | A | * | 8/1998 | Vila et al. | 5/18.1 |
| 6,463,603 | B1 | | 10/2002 | Camfield | 5/18.1 |
| 2003/0025424 | A1 | * | 2/2003 | Graves | 312/198 |

* cited by examiner

*Primary Examiner*—Michael Safavi
(74) *Attorney, Agent, or Firm*—Jenkens & Gilchrist

(57) ABSTRACT

A convertible bench including a frame having a stationary top. The convertible bench also includes a hinged top hinged to the stationary top and movable between a seat position and a bed position. A drawer is housed in the frame and is movable between an open and a closed position. The hinged top and the stationary top create a level surface when the hinged top is in a bed position and the drawer is in an open position.

20 Claims, 5 Drawing Sheets

CONVERTIBLE BENCH

BACKGROUND OF THE INVENTION

Oftentimes, visitors to a hospital may wish to spend the night in the hospital room with the patient. As a result, hospitals often include guest beds in the hospital rooms for the visitor. However, there is limited space in a hospital room, and during the day, a second bed may be in the way of visitors and the medical staff.

Currently, many hospitals use reclining chairs or chairs that pull out into a bed. Reclining chairs or chairs that convert to a bed are often not very comfortable. Reclining chairs do not fold all the way out in to a bed, limiting the sleep positions of the visitor. Fold out chairs are often narrow, which is uncomfortable for the visitor. Also, when being used as a bed, since the chairs are not the size or shape of a standard bed, regular linens do not fit on the converted chair. This creates a sanitary problem since the hospital cannot easily wash the chairs after they have been slept on. Furthermore, when being used as chairs, reclining chairs and fold out chairs can only fit a single visitor, which makes it difficult for numerous visitors to be in the room with a patient at one time.

Other hospitals use convertible sofas as beds. These have the advantage that the mattress size is the same as a bed and linens can be used on them. However, the ticking of the mattresses are not made of the same material as the ticking hospital beds, which are resistant to liquid spills and leaks. The mattresses are more easily soiled and more difficult to keep clean. Also, sofa beds are not very comfortable, as the mattresses are usually very thin, and the support wires can be felt through the mattress. Also, sofa beds take up large amounts of room even when they are in a closed position. The backs and arms of sofa beds can sometimes block windows, interfering with window and blind operation. Also, most sofa beds pull out to a queen size bed, which is too large for many hospital rooms.

Thus, there is a need for a convertible hospital bed that can comfortably seat multiple visitors during the day and is also comfortable to sleep on at night. There is also a need for a convertible bed that can use a mattress that is the same size as a standard bed and that can use ticking of the same material as hospital beds, so that the bed can be easily sanitized after use.

SUMMARY OF THE INVENTION

In accordance with the present invention, there is provided a convertible bench. The convertible bench includes a frame having a stationary top and a hinged top hinged to the stationary top. The hinged top is movable between a seat position and a bed position. The convertible bench also includes a drawer, which is housed in the frame and movable between an open and a closed position. When the hinged top is in a bed position and the drawer is in an open position, the hinged top and the stationary top create a level surface.

The above summary of the present invention is not intended to represent each embodiment, or every aspect, of the present invention.

BRIEF DESCRIPTION OF THE DRAWINGS

The foregoing and other advantages of the invention will become apparent upon reading the following detailed description and upon reference to the drawings.

Figure 1:
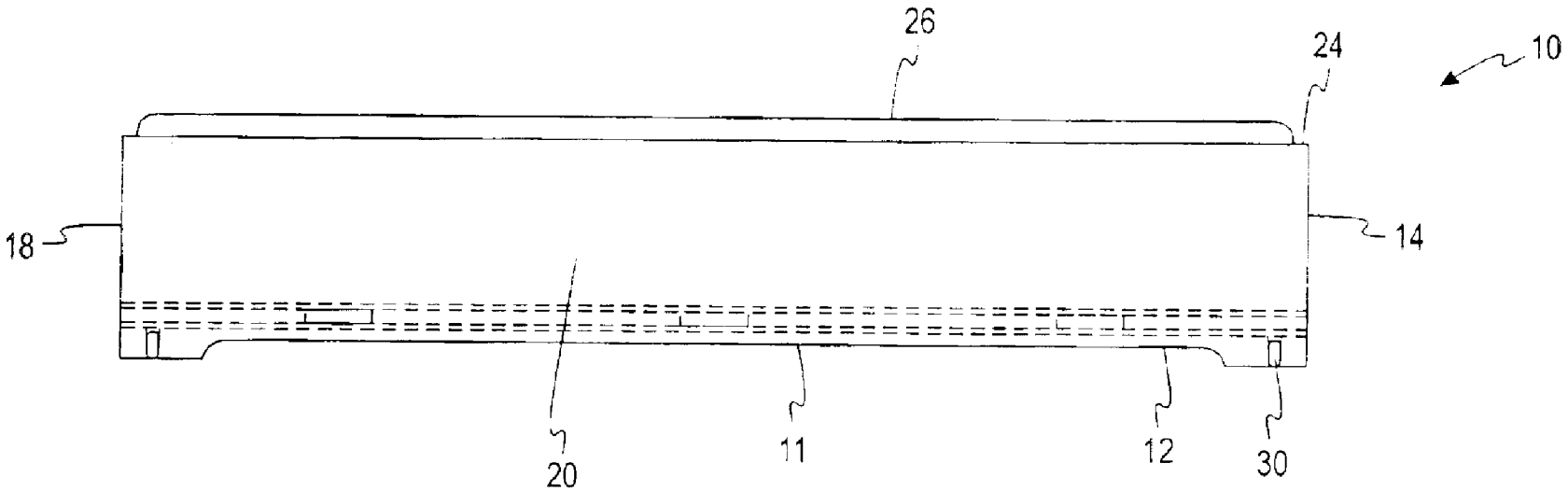
FIG. 1 is a side view of a convertible bench according to one embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Figure 2:
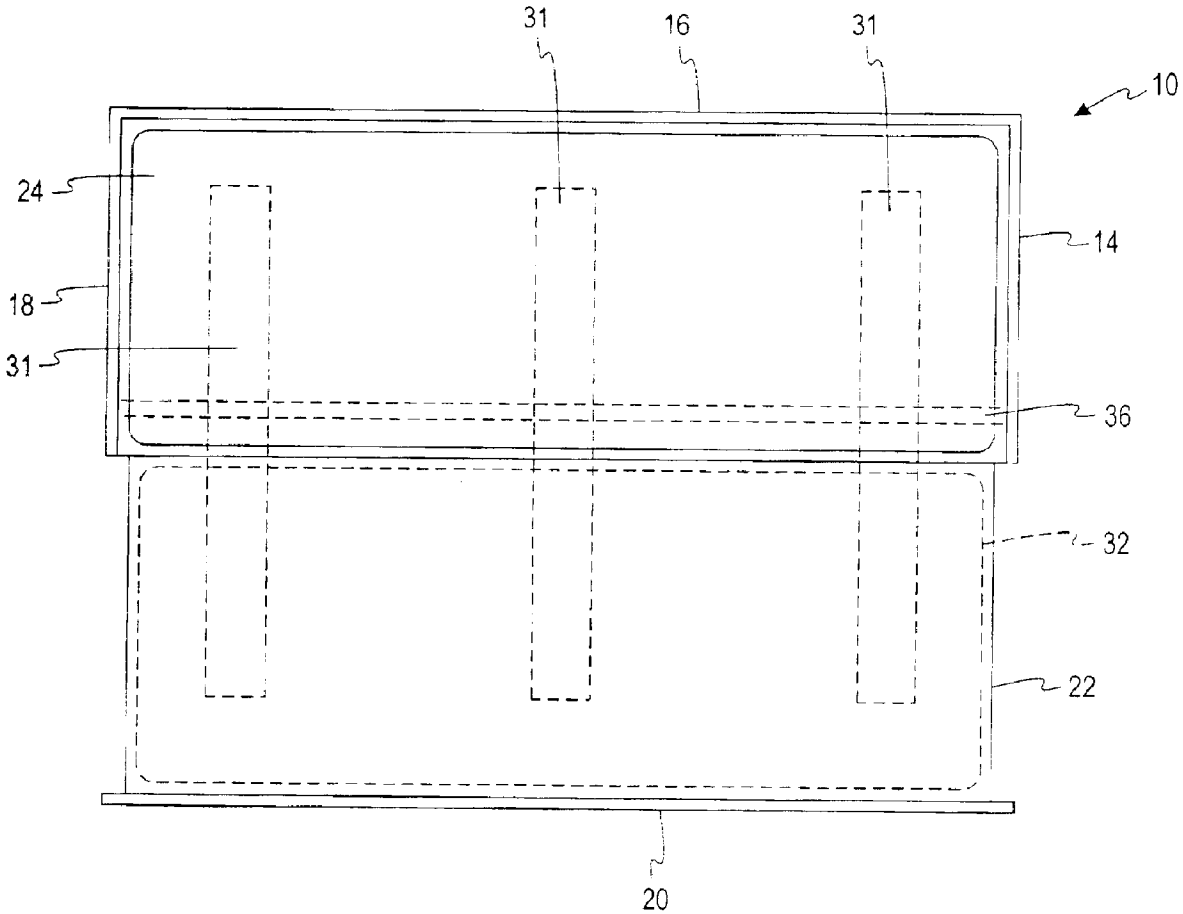
FIG. 2 is a top view of the convertible bench of FIG. 1 with a drawer in an open position.

In the embodiment shown in FIGS. 1 and 2, a convertible bench 10 is shown. The convertible bench 10 includes a base 12 and a frame 13. The base 12 includes a raised platform 11. The frame 13 comprises three walls 14, 16, 18, integrally connected to the base 12 and extending upwardly from the base 12. The frame 13 houses a drawer 22 having a front wall 20, the drawer being movable between an open and a closed position. In FIG. 1, the drawer 22 is shown in a closed position. Located on top of the three walls 14, 16, 18 is a hinged top 24. In this embodiment, the hinged top 24 includes a cushion 26. The cushion 26 may be attached to the hinged top 24 to prevent sliding when people sit on the bench 10. Also, the cushion 26 may be easily removable for cleaning and/or reupholstering purposes.

The drawer 22 slides between the open and closed position by wheels 30 and a suspension mechanism 31. The wheels 30 keep the drawer 22 steady as it is rolled out into the open position. The wheels 30 also act to provide support to the drawer 22 when it is in the open position. As shown in FIG. 3, the base 12 includes cut-outs (not shown) for receiving the wheels 30 when the drawer 22 is in the closed position.

In the illustrated embodiment, the suspension mechanism 31 is included on the bottom of the drawer 22, connecting the drawer 22 and the platform 11. The suspension mechanism 31 includes three ball bearing/rail systems substantially equally spaced across the bottom of the drawer 22 to open and close the drawer 22 evenly. The suspension system 31 supplies a smooth, even ride and stops the drawer 22 from being completely pulled off of the bench 10 or being pulled past the open position. In other embodiments, the suspension mechanism 31 comprises wheel and rail suspension systems, instead of ball bearings. Other suspension mechanisms as known in the art would also be suitable.

Figure 3A:
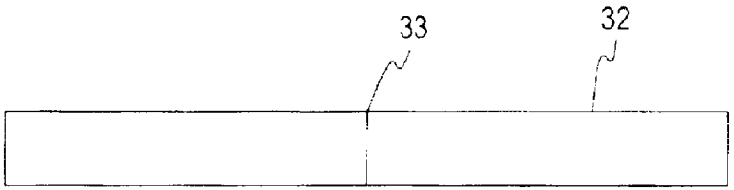
FIG. 3*a* is a end view of a hinged mattress in an unfolded position according to one embodiment of the present invent.
Figure 3B:
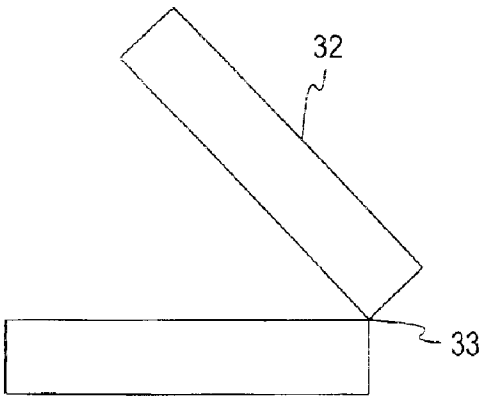
FIG. 3*b* is an end view of the hinged mattress of FIG. 4*a* in a partially folded position.
Figure 3C:
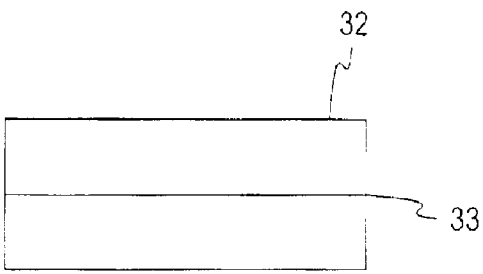
FIG. 3*c* is an end view of the hinged mattress of FIG. 4*c* in a folded position.

The drawer 22 is large enough to hold a hinged mattress 32, as shown in phantom in FIG. 2. Turning now to FIGS. 3*a*–3*c*, the hinged mattress 32 is illustrated in various folded and unfolded positions. The hinged mattress 32 includes a seamed hinge 33 down the middle of the mattress 32, allowing it to be folded in half (as shown in FIG. 3*c*) to fit in the drawer 22. In some embodiments, the foam filled mattress is approximately 5 inches thick. The ticking on the mattress may be a medically approved ticking such as those provided by Ventex, Inc. of Great Falls, Va., making it cleanable and water resistant. Alternatively, the ticking may also be made of a more conventional vinyl material, which is also easy to clean and provides a moisture barrier. The mattress 32 may come in standard mattress sizes (twin, full, and queen), so the mattress can be fitted with standard linens (not shown).

Figure 4:
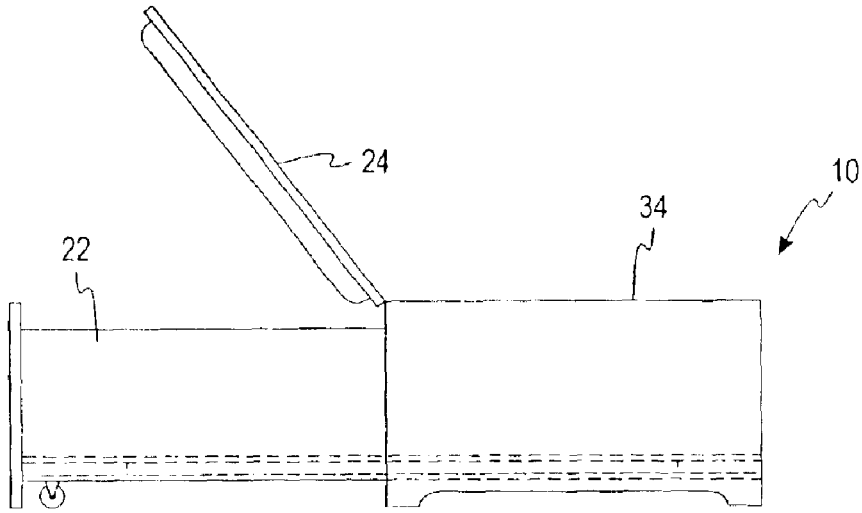
FIG. 4 is an end view of the convertible bench of FIG. 1 with the drawer in an open position.
Figure 5:
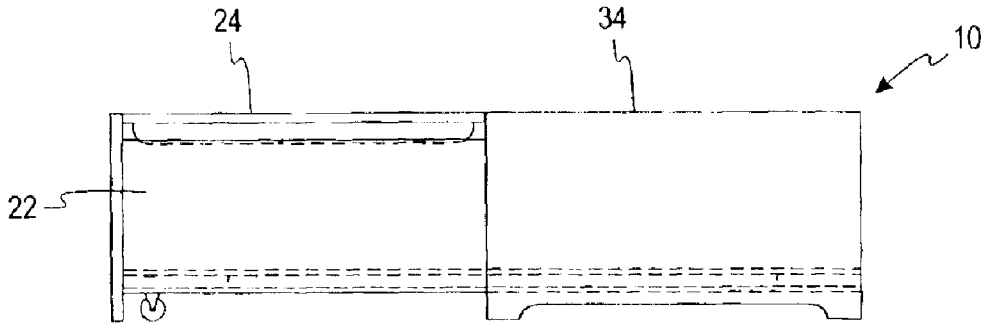
FIG. 5 is an end view of the convertible bench of FIG. 1 with a hinged top in an open position.

Turning now to FIG. 4, the bench 10 is shown with the drawer 22 in an open position and with the hinged top 24 in an upright position. Below the hinged top 24 is a stationary top 34 that is secured to the three walls 14, 16, 18. The hinged top 24 is movable between a seat position (FIG. 1) and a bed position (FIG. 5).

A support bar 36 runs across the length of the stationary top 34, inside the bench 10 (shown in FIG. 2). The support bar 36 provides support to the edge of the bench 10 when it is being used as a seat and support to the middle of a bed when the drawer 22 is pulled out and the hinged top 24 is in a bed position. In some embodiments, the support bar is a heavy gauge steel support tube that is attached with threaded T-nuts.

Figure 6:
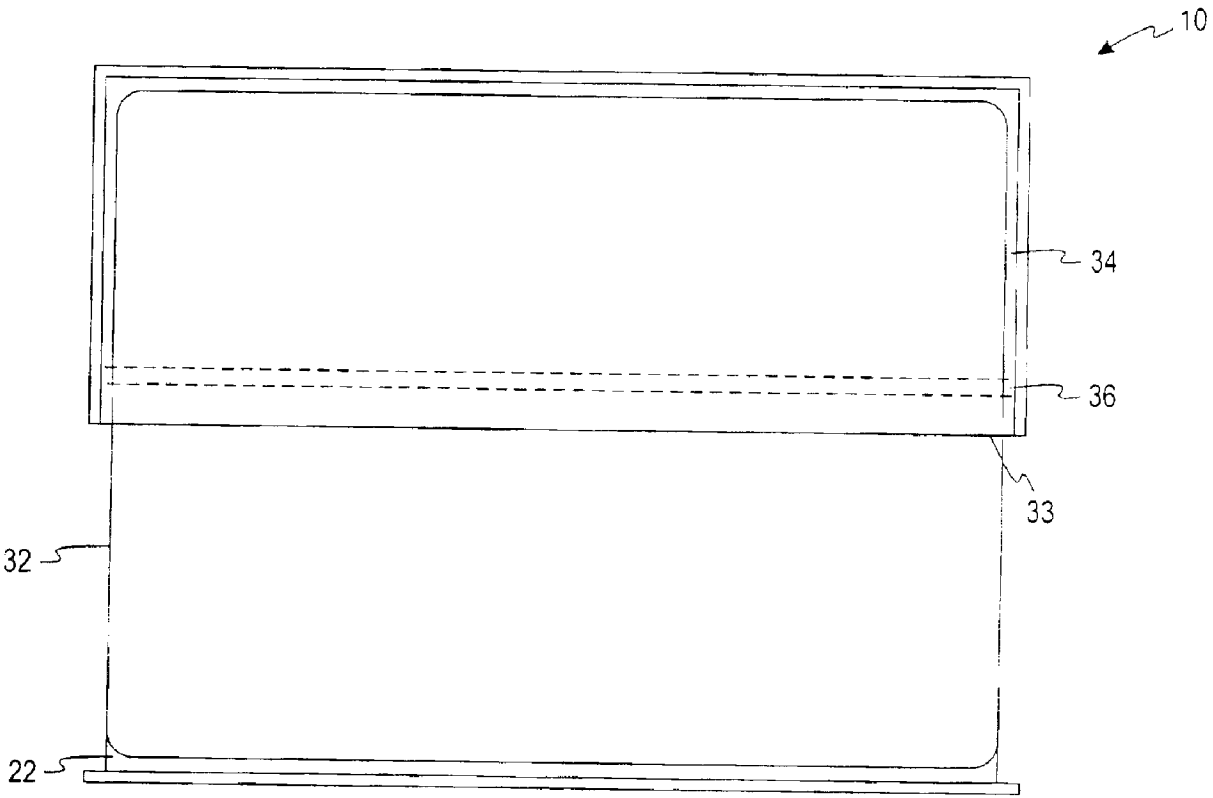
FIG. 6 is a top view of the convertible bench of FIG. 1 with a mattress on top.

Turning now to FIG. 6, the convertible bench 10 is shown in its bed position. The mattress 32 is unfolded and extends evenly across the stationary top and the hinged top, providing the user a full, even comfortable mattress on which to sleep. As stated above, the mattress is made of high density foam and is approximately 5 inches thick.

In one embodiment, the bench 10 is approximately 22 inches wide when it is in the closed position and 42 inches wide when it is in the open position. The bench 10 is approximately 78 inches long and 19 inches high. The drawer is approximately 77 inches long by 21 inches deep by 11 inches high in dimension, with the front wall 20 of the drawer 22 being higher to match evenly with the hinged top 24 when the hinged top is in the seat position. The hinged mattress 32 is approximately 38 by 74 by 5 inches unfolded (the standard twin size mattress) and 19 by 74 by 10 inches when folded. Other sizes of mattresses and benches may be manufactured depending on the needs of the user.

The operation of the convertible bench will now be described. When there are no overnight guests or during the day, the convertible bench 10 can be kept in the bench position. The support bar 36 extends across the front of the bench, providing support to the edge of the seat. The drawer 22 is kept in its closed position, and the hinged top 24 is kept in the seat position, with the cushion 26 on top of the bench 10, creating a comfortable bench for visitors. To convert the bench 10 into a bed, the drawer 22 is slid open using the suspension mechanism 31 and the wheels 30. The suspension system 31 ensures that the drawer 22 cannot be pulled past the open position. When the drawer 22 is fully open, the drawer 22 is able to properly accept the hinged top 24. To open the drawer 20 fully, the drawer should be pulled out until the suspension system 31 stops it from opening further. The drawer 22 is then completely open and prepared to receive the hinged top 24.

In some embodiments, the hinged mattress 32 and appropriate linens can be stored in the drawer 22. The hinged mattress 32 is removed and unfolded. The hinged top 24 is then flipped over into the bed position (as shown in FIG. 5), covering the drawer 22. The hinged top 24 engages the drawer 22, creating a secure cover. The hinged top 24 and the stationary top 34 create a level platform, or bed surface, on is which to place the unfolded mattress 32. Once the mattress 32 is in place, the mattress can be made up with the linens provided in the drawer. The bench 10 has now been converted into a bed for sleeping. The support bar 36 is now in the middle of the bed and keeps the middle of the bed from sagging under the weight of the person sleeping on the bed. Also, because the support bar 36 extends across the entire length of the bed and is attached to the underside of the stationary top 34 and not in direct contact with the mattress 32, as in most sleeper sofas, the bench 10 provides a comfortable sleep surface without any protrusions.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A convertible bench comprising:

a frame having a stationary top;

a hinged top hinged to the stationary top and movable between a seat position and a bed position;

a drawer, the drawer housed in the frame and movable between an open and a closed position; and a mattress adapted to cover the hinged top and the stationary top when the hinged top is in a bed position, wherein the mattress is a hinged mattress adapted to fit inside the drawer;

wherein the hinged top and stationary top create a level surface when the hinged top is in a bed position and the drawer is in an open position and wherein the drawer is movable independent of the hinged top.

2. The convertible bench of claim 1, wherein the hinged top is adapted to engage the drawer when the drawer is an open position and the hinged top is in a bed position.

3. The convertible bench of claim 1, further comprising a support beam extending along the stationary top, near the hinge.

4. The convertible bench of claim 1, wherein the drawer includes wheels adapted to aid moving the drawer between the open and closed position.

5. The convertible bench of claim 1, further comprising a suspension mechanism connecting the drawer and the frame, the suspension mechanism adapted to aid in moving the drawer between the open and closed position.

6. The convertible bench of claim 5, wherein the suspension mechanism is adapted to prevent the drawer from opening past the open position.

7. The convertible bench of claim 5, wherein the suspension mechanism comprises at least one ball bearing and rail suspension mechanism.

8. The convertible bench of claim 1, wherein the hinged top includes a removable, stationary cushion.

9. A method of manufacturing a convertible bench comprising:

providing a frame having a stationary top;

housing a drawer in the frame, the drawer movable between an open position and a closed position and the drawer operable independently of a hinged top;

attaching the hinged top to the stationary top, the hinged top movable between a bench position and a bed position, wherein when the hinged top is in the bed position and the drawer is in the open position, the hinged top and the stationary top create a level surface;

providing a mattress, the mattress adapted to lay across the stationary top and the hinged top when the hinged ton is in a bed position, wherein the mattress is a hinged mattress and is adapted to be folded and stored within the drawer.

10. The method of claim 9, further comprising connecting a suspension mechanism between the drawer and the frame, the suspension mechanism adapted to slide the drawer between the open position and the closed position.

11. The method of claim 9, further comprising attaching wheels to a bottom of the drawer for sliding the drawer between the open and closed position.

12. The method of claim 9, further comprising attaching a cushion to the hinged top.

13. A convertible bench system, the bench convertible to a bed, comprising:

a frame having a stationary top;

a drawer housed within the frame, the drawer movable between an open position and a closed position;

a hinged top hinged to the stationary top, the hinged top movable between a bed position and a bench position;

a support bar under the stationary top and extending along the frame; and a hinged mattress, foldable to fit within the drawer;

wherein the hinged top opens to create a bed surface with the stationary top and the mattress is adapted to lay over the bed surface and wherein the drawer opens independent of the hinged top.

14. The convertible bench system of claim 13, wherein the hinged top is adapted to engage the drawer when the drawer is in the open system and the hinged top is in a bed position.

15. The convertible bench system of claim 13, wherein the mattress is a foam mattress.

16. The convertible bench system of claim 15, wherein the mattress includes a water-resistant ticking.

17. The convertible bench system of claim 13, wherein the drawer further includes wheels for moving the drawer between the open position and the closed position.

18. The convertible bench system of claim 17, further comprising a suspension mechanism connected to the frame and the drawer, the suspension mechanism for sliding the drawer between the open and the closed position.

19. The convertible bench system of claim 18, wherein the suspension mechanism comprises three substantially equally-spaced ball bearing and rail systems.

20. The convertible bench system of claim 13, wherein the hinged top includes a cushion, the cushion adapted to act as a seat when the hinged top is in a seat position.

* * * * *

UNITED STATES PATENT AND TRADEMARK OFFICE

CERTIFICATE OF CORRECTION

PATENT NO. : 6,934,979 B2
DATED : August 30, 2005
INVENTOR(S) : Ralph J. Swan

It is certified that error appears in the above-identified patent and that said Letters Patent is hereby corrected as shown below:

Column 5,
Line 70, delete "ton" and insert -- top --.

Signed and Sealed this

Twenty-first Day of March, 2006

JON W. DUDAS
*Director of the United States Patent and Trademark Office*